US007644470B2

(12) United States Patent
Lee et al.

(10) Patent No.: US 7,644,470 B2
(45) **Date of Patent: *Jan. 12, 2010**

(54) COMPLEX TYPE CLEANER

(75) Inventors: Yong Woo Lee, Seoul (KR); Choon Myun Chung, Gyeonggi-Do (KR); Ho Seon Rew, Seoul (KR); Hyeun Sik Nam, Seoul (KR); Young Gyu Jung, Incheon (KR)

(73) Assignee: LG Electronics Inc., Seoul (KR)

( * ) Notice: Subject to any disclaimer, the term of this patent is extended or adjusted under 35 U.S.C. 154(b) by 735 days.

This patent is subject to a terminal disclaimer.

(21) Appl. No.: 11/029,382

(22) Filed: Jan. 6, 2005

(65) Prior Publication Data

US 2006/0090285 A1 May 4, 2006

(30) Foreign Application Priority Data

Nov. 3, 2004 (KR) ..... 10-2004-0088943

(51) Int. Cl.
*A47L 7/00* (2006.01)
*A47L 9/18* (2006.01)

(52) U.S. Cl. ..... 15/320; 15/353

(58) Field of Classification Search ..... 15/320–322, 15/328, 331, 353
See application file for complete search history.

(56) References Cited

U.S. PATENT DOCUMENTS 5,168,599 A * 12/1992 Williams ..... 15/346
5,241,724 A 9/1993 Lim
5,555,597 A * 9/1996 Berfield ..... 15/321
5,697,119 A 12/1997 Mussalo
5,715,566 A * 2/1998 Weaver et al. ..... 15/320
6,101,668 A * 8/2000 Grey ..... 15/322
6,131,237 A * 10/2000 Kasper et al. ..... 15/320
6,167,586 B1 1/2001 Reed, Jr. et al.
6,230,362 B1 * 5/2001 Kasper et al. ..... 15/320
6,243,912 B1 * 6/2001 Grey ..... 15/320

(Continued)

FOREIGN PATENT DOCUMENTS

CN 2498978 7/2002

(Continued)

OTHER PUBLICATIONS

English Language Abstract of CN 2498978.

(Continued)

*Primary Examiner*—David B Thomas
(74) *Attorney, Agent, or Firm*—Ked & Associates LLP

(57) ABSTRACT

A complex type cleaner is provided. The complex type cleaner includes a body having either a dust collecting container that stores dust or a water collecting container that stores contaminated water, a fan motor installed in the body that generates a suction force, a suction head arranged at a lower side of the body, that sucks dust at a time of performing a vacuum cleaning operation, a water tank mounted adjacent the suction head, that stores cleaning water to be sprayed onto a region to be cleaned at a time of performing a water cleaning operation, and a suction nozzle integrally formed with the water tank, that sucks water contaminated after completing the water cleaning operation. The complex type cleaner so configured reduces a number of components, reduces a fabrication cost, and has a large capacity water tank.

20 Claims, 5 Drawing Sheets

U.S. PATENT DOCUMENTS

| | | | | |
|---|---|---|---|---|
| 6,286,181 | B1 * | 9/2001 | Kasper et al. | 15/320 |
| 6,438,793 | B1 * | 8/2002 | Miner et al. | 15/320 |
| 6,446,302 | B1 * | 9/2002 | Kasper et al. | 15/319 |
| 6,609,269 | B2 * | 8/2003 | Kasper | 15/320 |
| 6,629,332 | B2 * | 10/2003 | Morgan et al. | 15/320 |
| 6,647,578 | B2 * | 11/2003 | Morgan et al. | 15/49.1 |
| 6,832,409 | B2 * | 12/2004 | Morgan et al. | 15/354 |
| 6,880,199 | B1 * | 4/2005 | Huffman et al. | 15/320 |
| 6,898,820 | B2 * | 5/2005 | Kasper et al. | 15/320 |
| 6,941,064 | B2 * | 9/2005 | Thweatt, Jr. | 392/488 |
| 7,000,286 | B2 | 2/2006 | Wang | |
| RE39,304 | E * | 9/2006 | Kasen et al. | 15/320 |
| 7,159,271 | B2 * | 1/2007 | Sepke et al. | 15/320 |
| 7,254,864 | B2 * | 8/2007 | Cipolla et al. | 15/320 |
| 7,322,071 | B2 * | 1/2008 | Lee et al. | 15/320 |
| 7,373,690 | B2 * | 5/2008 | Sepke et al. | 15/410 |
| 2003/0014829 | A1 | 1/2003 | Wang | |
| 2005/0034266 | A1 * | 2/2005 | Morgan et al. | 15/354 |
| 2005/0091783 | A1 * | 5/2005 | Sepke et al. | 15/320 |
| 2005/0120508 | A1 * | 6/2005 | Morgan et al. | 15/320 |
| 2006/0000050 | A1 * | 1/2006 | Cipolla et al. | 15/353 |
| 2006/0085941 | A1 | 4/2006 | Lee et al. | |
| 2006/0260088 | A1 * | 11/2006 | Nam et al. | 15/320 |
| 2008/0072395 | A1 * | 3/2008 | McDowell | 15/320 |

FOREIGN PATENT DOCUMENTS

| | | |
|---|---|---|
| DE | 19541739 | 5/1997 |
| EP | 0373051 | 6/1990 |
| GB | 2419515 | 5/2005 |
| JP | 1-043218 | 2/1989 |

OTHER PUBLICATIONS

U.S. Appl. No. 11/029,383, filed Jan. 6, 2005.
U.S. Appl. No. 11/029,365, filed Jan. 6, 2005.
U.S. Appl. No. 10/720,113, filed Nov. 25, 2003.
U.S. Appl. No. 10/879,106, filed Jun. 30, 2004.
U.S. Appl. No. 11/028,236, filed Jan. 4, 2005.
English language Abstract of JP 1-043218.

* cited by examiner

COMPLEX TYPE CLEANER

BACKGROUND OF THE INVENTION

1. Field of the Invention

The present invention relates to a complex type cleaner, and more particularly, to a complex type cleaner capable of selectively performing a vacuum cleaning for sucking dust and foreign materials and a water cleaning for cleaning a region to be cleaned by spraying cleaning water in one cleaner.

2. Description of the Conventional Art

Generally, an upright type vacuum cleaner comprises: a body arranged in an upright state; a suction fan mounted in the body and generating a suction force; a filter container having a filter for collecting dust and foreign materials sucked by a suction force generated from the suction fan therein; a suction head arranged at a lower side of the body, for sucking dust and foreign materials of a floor; and a brush rotatably installed at the suction head, for brushing up dust and foreign materials of a floor.

In the upright type vacuum cleaner, when the suction fan is driven, a suction force is generated and dust and foreign materials of a floor are sucked to the suction head by the generated suction force. Then, the dust and foreign materials are filtered by the filter and are collected in the filter container.

A general extractor includes: a water supply container in which cleaning liquid is contained; a pump for pumping the cleaning liquid contained in the water supply container; a spray nozzle for spraying the cleaning liquid pumped by the pump to a region to be cleaned; a suction nozzle for sucking contaminated water and dust of the region to be cleaned; a water collecting container for storing the contaminated water sucked to the suction nozzle; and a suction fan for generating a suction force so that contaminated water can be sucked into the suction nozzle.

As a pump of the extractor is driven, the cleaning liquid stored in the water supply container is sprayed on a carpet, etc. and the carpet is rubbed while the brush is rotated. Then, contaminated water is sucked by the suction nozzle and is collected into the water collecting container. At this time, air is exhausted to the outside.

In the conventional cleaner, a vacuum cleaner for vacuum-cleaning dust and foreign materials and a water cleaner for water-cleaning a carpet, etc. have to be provided thereby to increase the cost. Also, a large space for storing two cleaners is required thereby to have inconvenience in storing the cleaners.

SUMMARY OF THE INVENTION

Therefore, an object of the present invention is to provide a complex type cleaner capable of reducing a cost, enhancing a user's convenience, and enabling a convenient storage by performing a vacuum-cleaning for sucking dust and a water-cleaning for sucking water by spraying cleaning water to a region to be cleaned in one cleaner.

Another object of the present invention is to provide a complex type cleaner capable of reducing the number of components, reducing a fabrication cost, and having a water tank of a large capacity by integrally installing a suction nozzle for sucking water contaminated after completing a cleaning and a water tank for storing cleaning water to be sprayed to a region to be cleaned at a suction head.

To achieve these and other advantages and in accordance with the purpose of the present invention, as embodied and broadly described herein, there is provided complex type cleaner comprising: a body having either a dust collecting container for storing dust or a water collecting container for storing contaminated water; a fan motor installed at the body and generating a suction force; a suction head arranged at a lower side of the body, for sucking dust at the time of performing a vacuum-cleaning; a water tank mounted at the suction head, for storing cleaning water to be sprayed to a region to be cleaned at the time of performing a water-cleaning; and a suction nozzle integrally formed at the water tank, for sucking water contaminated after completing the water cleaning.

The body is provided with a container mounting portion for mounting either the dust collecting container or the water collecting container, and is provided with a handgrip at an upper side thereof. A vacuum cleaning switch adjusted at the time of a vacuum cleaning mode, and a water cleaning switch adjusted at the time of a water cleaning mode are installed at the handgrip.

A dust suction opening for sucking dust is formed at a lower surface of the suction head, and a suction hose for guiding dust sucked into the dust suction opening to the dust collecting container is connected to a rear side of the suction head.

The water tank is installed at an upper surface of the suction head, and is connected to a cleaning water supplying unit for supplying water stored in the water tank to a region to be cleaned.

The cleaning water supplying unit is composed of: a cleaning water supplying hose connected to the water tank, for supplying cleaning water stored in the water tank to a region to be cleaned; a pump installed at the cleaning water supplying hose, for pumping cleaning water stored in the water tank; and a spray nozzle mounted at the end of the cleaning water supplying line, for spraying cleaning water pumped by the pump to a region to be cleaned.

The suction nozzle is integrally formed at an upper surface of the water tank, and a hose connection portion to which the suction hose for guiding contaminated water sucked into the suction nozzle into the water collecting container is connected is formed at an upper side of the suction nozzle.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENTS

Reference will now be made in detail to the preferred embodiments of the present invention, examples of which are illustrated in the accompanying drawings.

One embodiment of a complex type cleaner according to the present invention will be explained with reference to the attached drawings as follows.

Even if a plurality of preferred embodiments of the present invention may exist, the most preferred embodiment will be explained hereinafter.

Figure 1:
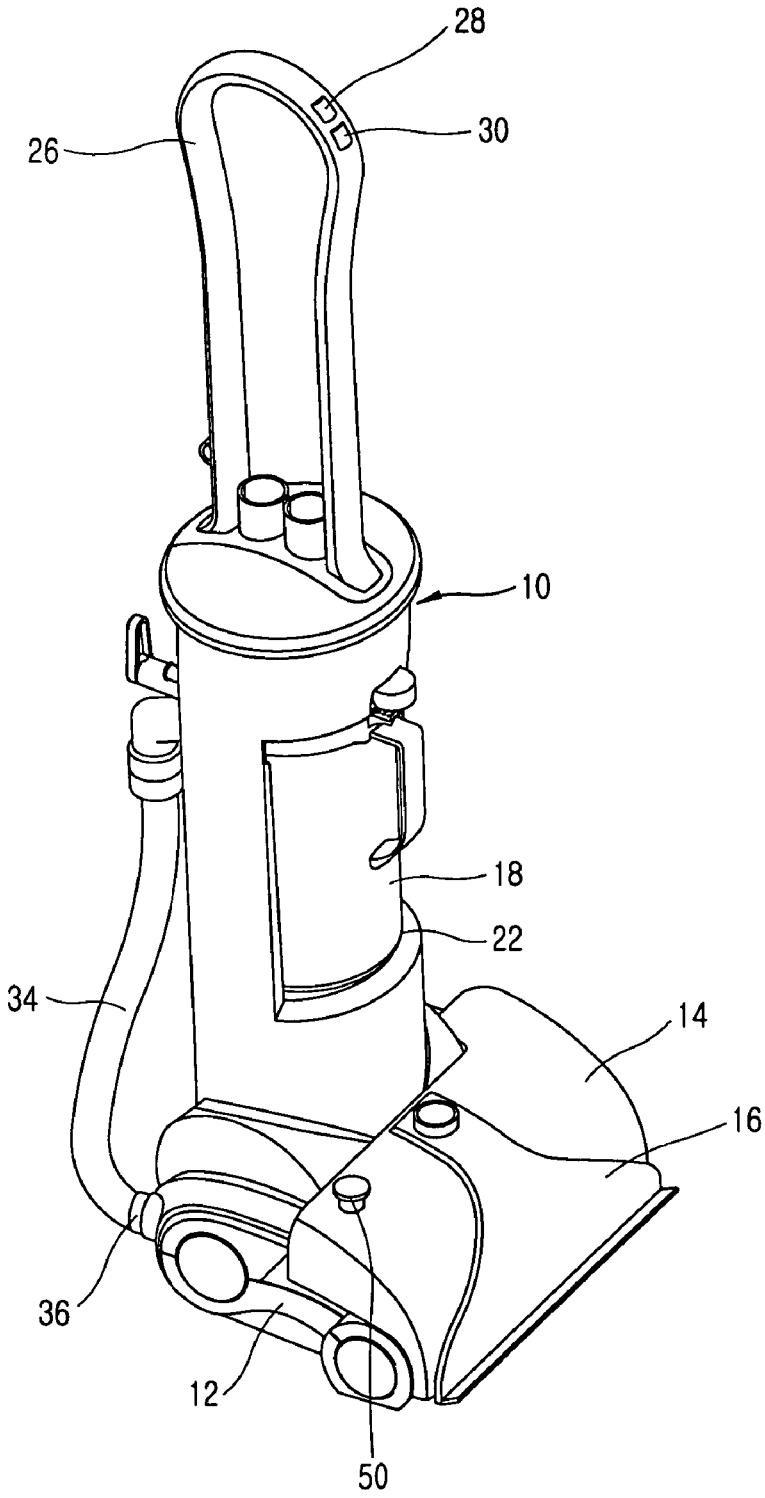
FIG. 1 is a perspective view showing a complex type cleaner according to one embodiment of the present invention.
Figure 2:
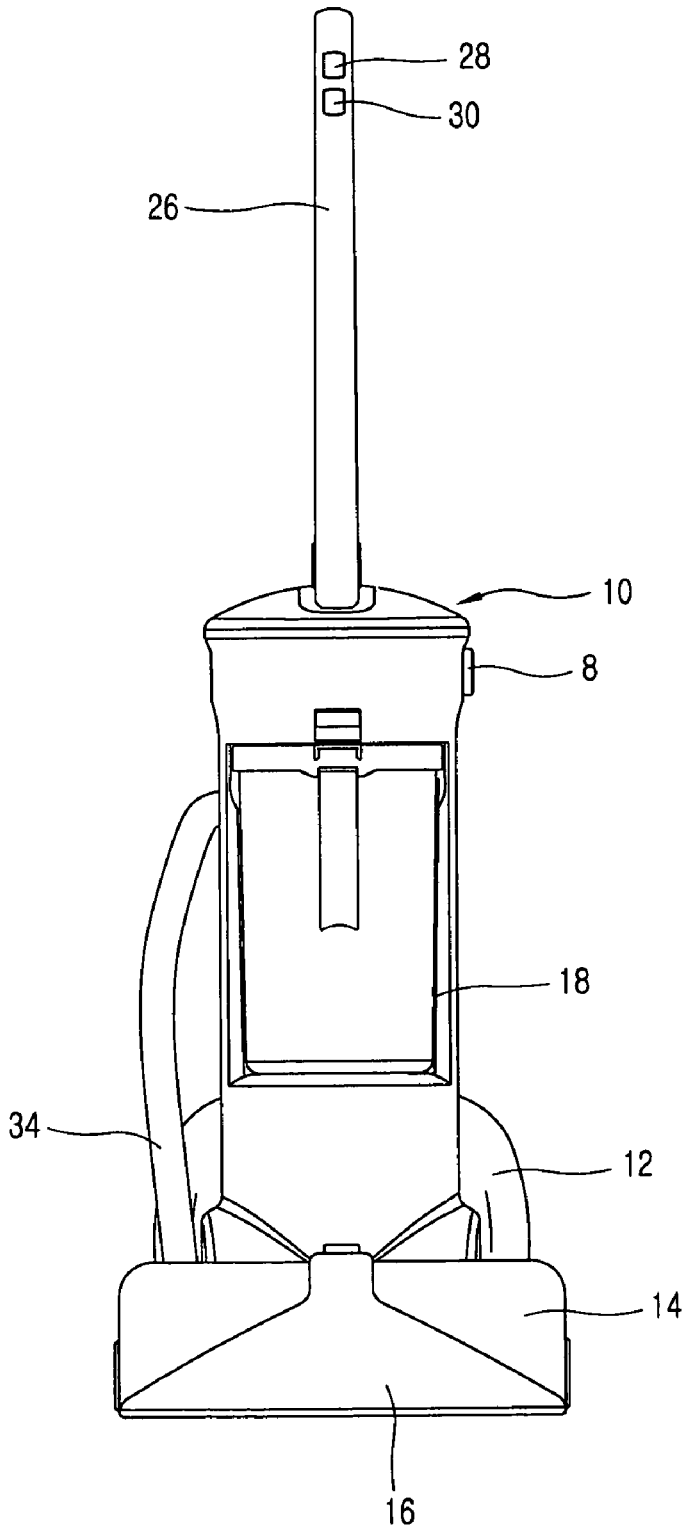
FIG. 2 is a lateral view showing the complex type cleaner according to one embodiment of the present invention.
Figure 3:
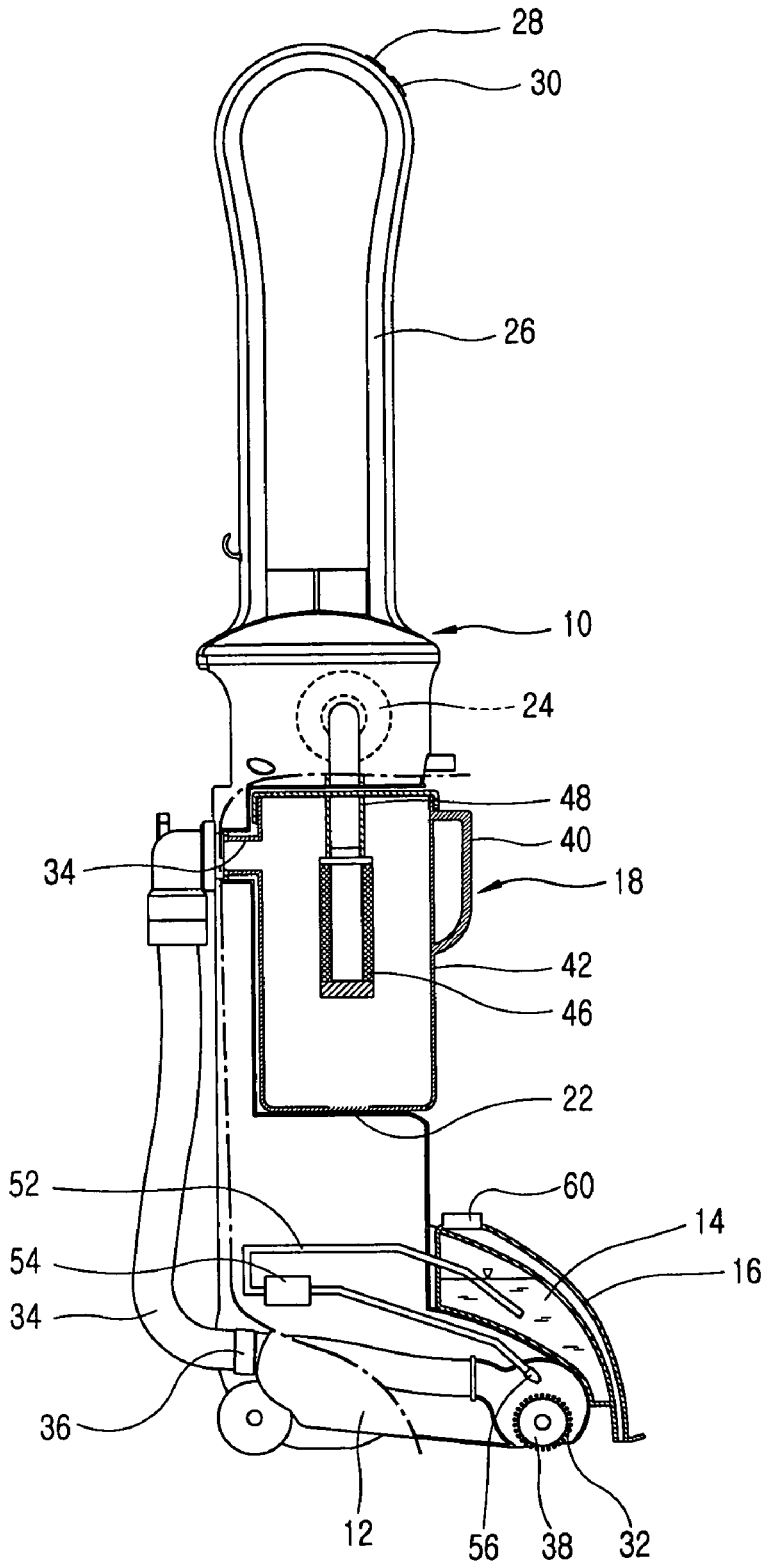
FIG. 3 is a sectional view showing the complex type cleaner according to one embodiment of the present invention.

FIG. 1 is a perspective view showing a complex type cleaner according to one embodiment of the present invention, FIG. 2 is a lateral view showing the complex type cleaner according to one embodiment of the present invention, and FIG. 3 is a sectional view showing the complex type cleaner according to one embodiment of the present invention.

The complex type cleaner according to one embodiment of the present invention comprises: a body 10 arranged in an upright state; a suction head 12 arranged at a lower side of the body 10, for sucking dust at the time of performing a vacuum-cleaning; a water tank 14 mounted at the suction head 12, for storing cleaning water to be sprayed to a floor at the time of performing a water-cleaning; and a suction nozzle 16 integrally formed at the water tank 14, for sucking water contaminated after completing the water cleaning.

A handgrip 26 is mounted at an upper side of the body 10, and a container mounting portion 22 for mounting either a dust collecting container 18 for collecting dust or a water collecting container 20 for collecting contaminated water is formed at a front side of the body 10. A fan motor for generating a suction force is mounted at an upper side of the container mounting portion 22, and an outlet 8 for exhausting air that has passed through the fan motor 24 to the outside is formed at an upper side of the container mounting portion 22.

A vacuum cleaning switch 28 adjusted by a user at the time of a vacuum cleaning mode for sucking dust, and a water cleaning switch 30 adjusted by a user at the time of a water cleaning mode are installed at the handgrip 26.

The suction head 12 is mounted at a lower portion of the body 10, and a dust suction opening 32 for sucking dust and foreign materials is formed at a lower surface of the suction head 12. A hose connection portion 36 to which a suction hose 34 for guiding dust sucked into the dust suction opening 32 to the dust collecting container 18 is connected is formed at a rear side of the suction head 12.

A brush 38 is rotatably mounted at a lower portion of the suction head 12. The brush brushes up dust and foreign materials on a floor or a carpet to an inner side of the dust suction opening 32 at the time of a vacuum-cleaning mode, and rubs a region to be cleaned onto which cleaning water is sprayed at the time of a water-cleaning mode.

The dust collecting container 18 includes: a container 42 mounted at a container mounting portion 22 formed at the body 10, having a space for collecting dust, and having a handgrip 40 at one side thereof; an inlet 44 formed at one side of the container 42, connected to the suction hose 34, for sucking dust and foreign materials into the container 42; a filter 46 arranged in the container 42, for filtering dust and foreign materials sucked into the container 42; and an exhaust passage 48 formed at a lower side of the container 42 and connected to the fan motor 24 and the filter 46, for exhausting air purified while passing through the filter 46.

Figure 4:
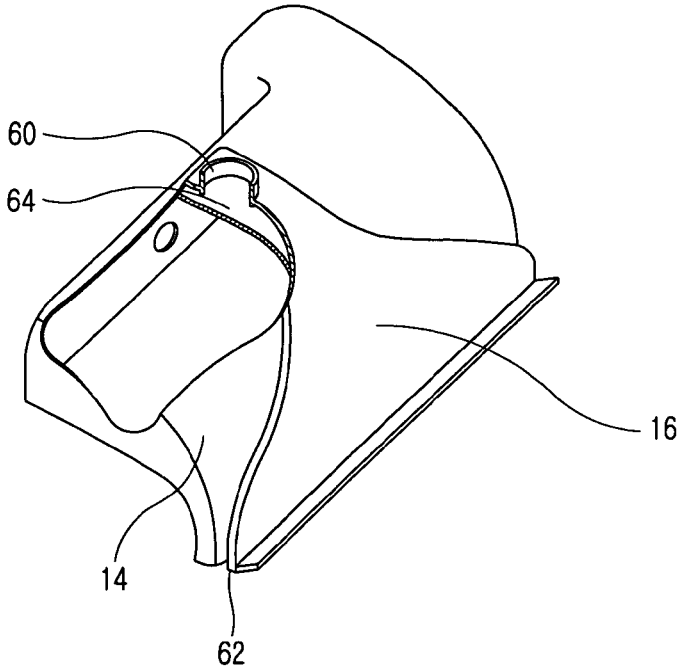
FIG. 4 is a perspective view of a suction head having a water tank according to one embodiment of the present invention.
Figure 5:
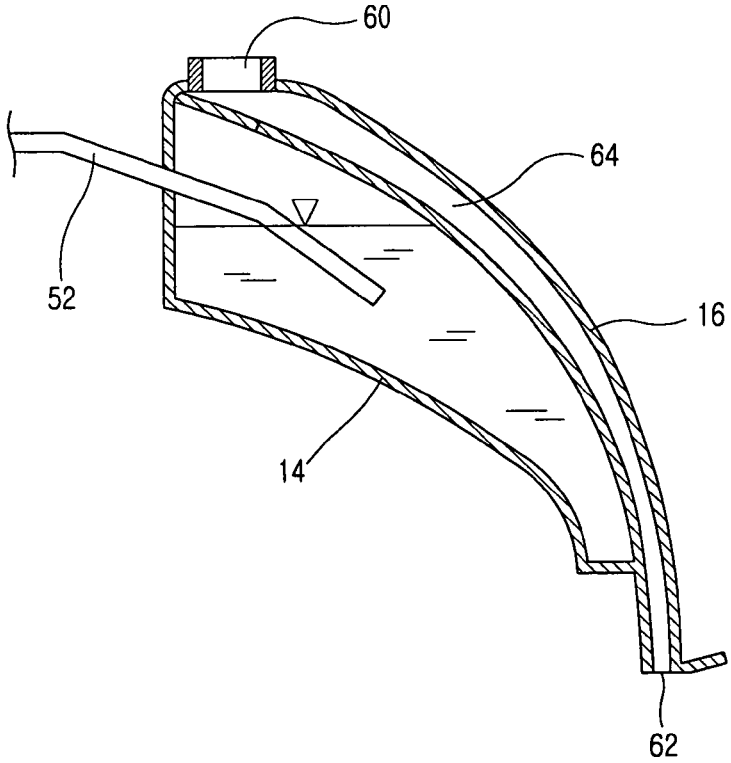
FIG. 5 is a sectional view of the suction head having a water tank according to one embodiment of the present invention.
Figure 6:
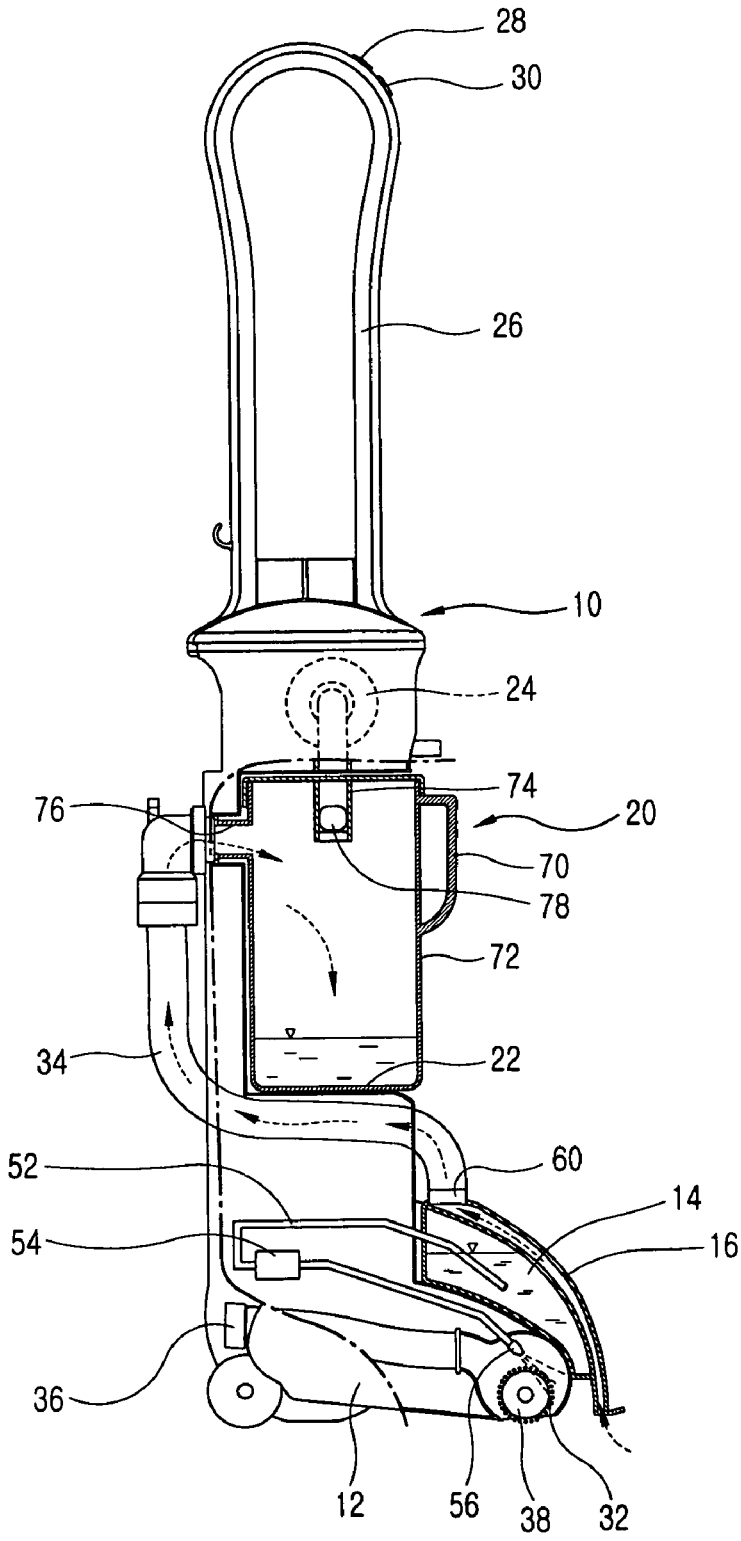
FIG. 6 is an operation state view of the complex type cleaner according to the present invention.

FIG. 4 is a perspective view of a suction head having a water tank according to one embodiment of the present invention, FIG. 5 is a sectional view of the suction head having a water tank according to one embodiment of the present invention, and FIG. 6 is an operation state view of the complex type cleaner according to the present invention.

The water tank 14 is mounted at an upper surface of the suction head 12, and has a space for storing cleaning water. A cleaning water supplying opening 50 for supplying cleaning water into the water tank 14 is formed at an upper side of the water tank. A cleaning water supplying unit for supplying cleaning water stored in the water tank 14 to a region to be cleaned is connected to the water tank 14.

The cleaning water supplying unit is composed of: a cleaning water supplying hose 52 connected to the water tank 14, for supplying cleaning water stored in the water tank 14 to a region to be cleaned; a pump 54 installed at the cleaning water supplying hose 52, for pumping cleaning water stored in the water tank 14; and a spray nozzle 56 installed at the end of the cleaning water supplying hose 52, for spraying cleaning water pumped by the pump 54 to a region to be cleaned.

The suction nozzle 16 is integrally formed at an upper surface of the water tank 14, and a hose connection portion 60 to which the suction hose 34 for guiding contaminated water sucked into the suction nozzle 16 into the water collecting container 20 mounted at the body 10 is connected is formed at an upper side of the suction nozzle 16.

The suction nozzle 16 is composed of: a nozzle portion 62 provided with an entrance having a narrow width in order to easily suck water of a floor; and a guide passage portion 64 integrally connected to the nozzle portion 62 and connected to the hose connection portion 60, for guiding contaminated water sucked into the nozzle portion 62 to the suction hose 34.

The water collecting container 20 is composed of: a container 72 having a space for storing contaminated water and having a handgrip 70 at one side thereof; an inlet 76 formed at one side of the container 72 and connected to the suction hose 34, for sucking dust and foreign materials into the container 72; an exhaust passage 74 formed at an upper side of the container 72 and connected to the fan motor 24, for exhausting air inside the container 72 when contaminated water is sucked into the container 72; and a floater 78 installed at the exhaust passage 74, for preventing contaminated water that has been sucked into the container 72 from being exhausted to the exhaust passage 74.

An operation of the complex type cleaner according to the present invention will be explained as follows.

First, the operation of the complex type cleaner in a vacuum cleaning mode will be explained with reference to FIG. 3. The user mounts the dust collecting container 18 at the container mounting portion 22 of the body 10, connects the suction hose 34 to the hose connection portion 36 of the suction head 12, and then operates the vacuum cleaning switch 28.

According to this, the fan motor 24 is operated to generate a suction force, and thereby dust and foreign materials on a floor or a carpet are sucked into the suction head 12 through the dust suction opening 32. At this time, the brush 38 mounted at the dust suction opening 32 is rotated, thereby brushing up dust and foreign materials on a floor or a carpet to the inner side of the suction head 12. The dust and foreign materials that have been sucked into the suction head 12 are introduced into the container 42 of the dust collecting container 18 through the suction hose 34. Then, the dust and foreign materials that have been sucked into the container 42 are filtered by the filter 46 and are collected in the container 42. Only the air that has been purified while passing through the filter 46 is exhausted through the exhaust passage 48, and is exhausted to the outside via the fan motor 24.

Second, the operation of the complex type cleaner in a water cleaning mode will be explained with reference to FIG. 6. The user connects the suction hose 34 to the hose connection portion 60 formed at the suction nozzle 16, and then operates the water cleaning switch 30 mounted at the body 10. According to this, the fan motor 24 is operated to generate a suction force. At the same time, the pump 54 is operated to spray cleaning water to a floor or a carpet.

By a pumping force generated as the pump 54 is operated, the cleaning water stored in the water tank 14 is guided to the spray nozzle 56 through the cleaning water supplying hose 52. The spray nozzle 56 sprays the cleaning water to a floor or a carpet.

Also, the brush 38 mounted in the suction head 12 is rotated, thereby rubbing a region to be cleaned or a carpet on which the cleaning water is sprayed. Then, water contaminated after completing the cleaning is sucked into the nozzle portion 62 of the suction nozzle 16 by a suction force generated as the fan motor 24 is operated.

The contaminated water that has been sucked into the nozzle portion 62 of the suction nozzle 16 is guided by the guide passage portion 64, and is introduced into the water collecting container 20 through the suction hose 34. At this time, the air inside the water collecting container 20 is exhausted through the exhaust passage 74, and is exhausted to the outside via the fan motor 24.

Effects of the complex type cleaner according to the present invention will be explained as follows.

In the complex type cleaner according to the present invention, a vacuum cleaning function for sucking dust and a water cleaning function for sucking water by spraying cleaning water to a region to be cleaned are realized in one cleaner, thereby reducing the cost, enhancing the user's convenience, and facilitating to store the cleaner.

Also, the water tank for storing cleaning water to be supplied to a region to be cleaned at the time of a water cleaning and the suction nozzle for sucking water contaminated after completing the cleaning are integrally formed at the suction head, thereby reducing the number of components and reducing the fabrication cost.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the metes and bounds of the claims, or equivalence of such metes and bounds are therefore intended to be embraced by the appended claims.

What is claimed is:

1. A complex type cleaner; comprising:

a body having either a dust collecting container that stores dust or a water collecting container that stores contaminated water;

a fan motor installed in the body that generates a suction force;

a suction head arranged on a lower side of the body, that sucks dust into the body at a time of performing a vacuum cleaning;

a water tank mounted adjacent the suction head, that stores cleaning water to be sprayed onto a region to be cleaned at a time of performing a water cleaning; and a suction nozzle integrally formed with the water tank, that sucks into the body water contaminated at the time of performing the water cleaning.

2. The complex type cleaner of claim 1, wherein the body comprises a container mounting portion that receives either the dust collecting container or the water collecting container mounted therein and a handgrip at an upper side thereof, wherein a vacuum cleaning switch adjusted at the time of a vacuum cleaning mode and a water cleaning switch adjusted at the time of a water cleaning mode are installed on the handgrip.

3. The complex type cleaner of claim 1, further comprising:

a dust suction opening through which dust is sucked into the body formed on a lower surface of the suction head; and a suction hose configured to be connected to a rear side of the suction head, the suction hose guiding dust that has been sucked into the dust suction opening to the dust collecting container when the suction hose is connected to the rear side of the suction head.

4. The complex type cleaner of claim 1, further comprising a brush that brushes up dust and foreign materials on the region to be cleaned at the time of a vacuum cleaning mode and that rubs the region to be cleaned onto which cleaning water is sprayed at the time of a water cleaning mode installed in the suction head.

5. The complex type cleaner of claim 1, wherein the water tank is installed on an upper surface of the suction head, and is connected to a cleaning water supplying device that supplies water stored in the water tank to the region to be cleaned.

6. The complex type cleaner of claim 5, wherein the cleaning water supplying device comprises:

a cleaning water supplying hose connected to the water tank, that supplies cleaning water stored in the water tank to the region to be cleaned;

a pump installed on the cleaning water supplying hose, that pumps the cleaning water stored in the water tank; and a spray nozzle mounted at an end of the cleaning water supplying hose, that sprays the cleaning water pumped by the pump to the region to be cleaned.

7. The complex type cleaner of claim 1, wherein the suction nozzle is integrally formed with an upper surface of the water tank, and a hose connection portion, to which a suction hose that guides contaminated water sucked into the suction nozzle into the water collecting container is connected, is formed at an upper side of the suction nozzle.

8. The complex type cleaner of claim 7, wherein the suction nozzle comprises:

a nozzle portion arranged at a front side of a dust sucking opening, that sucks water therethrough; and a guide passage portion integrally formed with the nozzle portion, that guides contaminated water sucked into the nozzle portion to the suction hose.

9. The complex type cleaner of claim 1, wherein the complex type cleaner is an upright type vacuum cleaner.

10. A vacuum cleaner, comprising:

a body having one of a dust collecting container or a water collecting container mounted thereon;

a fan motor installed in the body that generates a suction force;

a suction head provided on a lower portion of the body that sucks dust into the body during a vacuum cleaning operation;

a water tank mounted adjacent to the suction head; and a suction nozzle integrally formed with the water tank, that sucks into the body water contaminated during a water cleaning operation.

11. The vacuum cleaner of claim 10, wherein the body comprises a container mounting portion that receives either the dust collecting container or the water collecting container mounted therein.

12. The vacuum cleaner of claim 10, further comprising a suction hose configured to selectively extend between the container mounting portion in which one of the dust collecting container or the water collecting container is mounted and one of a hose connecting portion of the suction nozzle and a hose connecting portion of the suction nozzle.

13. The vacuum cleaner of claim 10, wherein the body comprises a handgrip at an upper end portion thereof wherein a vacuum cleaning switch for selecting the vacuum cleaning operation and a water cleaning switch for selecting the water cleaning operation are provided on the handgrip.

14. The vacuum cleaner of claim 10, further comprising:

a dust suction opening through which dust is sucked into the body formed on a lower surface of the suction head; and a suction hose configured to be connected to a rear portion of the suction head, the suction hose being configured to guide dust that has been sucked through the dust suction opening to the dust collecting container.

15. The vacuum cleaner of claim 10, further comprising a brush installed in the suction head that brushes up dust and foreign materials on a region to be cleaned during the vacuum cleaning operation and that rubs the region to be cleaned onto which cleaning water is sprayed during the water cleaning operation.

16. The vacuum cleaner of claim 10, wherein the water tank is installed on an upper surface of the suction head, and is connected to a cleaning water supplying device that supplies water stored in the water tank to the region to be cleaned.

17. The vacuum cleaner of claim 16, wherein the cleaning water supplying device comprises:

a cleaning water supplying hose connected to the water tank, that supplies cleaning water stored in the water tank to the region to be cleaned;

a pump installed on the cleaning water supplying hose, that pumps the cleaning water stored in the water tank; and a spray nozzle mounted at an end of the cleaning water supplying hose, that sprays the cleaning water pumped by the pump to the region to be cleaned.

18. The vacuum cleaner of claim 10, wherein the suction nozzle is integrally formed with an upper surface of the water tank, and a hose connection portion, to which a suction hose is configured to be connected, that guides contaminated water sucked into the suction nozzle into the water collecting container, is formed at an upper side of the suction nozzle.

19. The vacuum cleaner of claim 18, wherein the suction nozzle comprises:

a nozzle portion arranged at a front side of a dust sucking opening, that sucks water therethrough; and a guide passage portion integrally formed with the nozzle portion, that guides contaminated water sucked into the nozzle portion to the suction hose.

20. The vacuum cleaner of claim 10, wherein the vacuum cleaner is an upright type vacuum cleaner.

* * * * *